US010253935B2

(12) United States Patent
Huang

(10) Patent No.: US 10,253,935 B2
(45) Date of Patent: Apr. 9, 2019

(54) IMITATION CANDLE LAMP

(71) Applicant: Guozeng Huang, Dongguan (CN)

(72) Inventor: Guozeng Huang, Dongguan (CN)

( * ) Notice: Subject to any disclaimer, the term of this patent is extended or adjusted under 35 U.S.C. 154(b) by 0 days.

(21) Appl. No.: 15/688,710

(22) Filed: Aug. 28, 2017

(65) Prior Publication Data

US 2017/0356604 A1 Dec. 14, 2017

(30) Foreign Application Priority Data

Apr. 21, 2017 (CN) ..... 2017 1 0266171

(51) Int. Cl.

| | |
|---|---|
| ***F21S 10/04*** | (2006.01) |
| ***F21S 6/00*** | (2006.01) |
| ***F21S 9/02*** | (2006.01) |
| *F21W 121/00* | (2006.01) |
| *F21Y 115/10* | (2016.01) |

(52) U.S. Cl.

CPC ..... *F21S 6/001* (2013.01); *F21S 9/02* (2013.01); *F21S 10/04* (2013.01); *F21W 2121/00* (2013.01); *F21Y 2115/10* (2016.08)

(58) Field of Classification Search

CPC ..... F21S 10/04; F21S 6/001

See application file for complete search history.

(56) References Cited

U.S. PATENT DOCUMENTS 9,585,980 B1 * 3/2017 Li ..... F21S 6/001
9,810,388 B1 * 11/2017 Li ..... F21S 6/001
2006/0034100 A1 * 2/2006 Schnuckle ..... B44C 5/06 362/161
2012/0134157 A1 * 5/2012 Li ..... F21S 6/001 362/277
2013/0329406 A1 * 12/2013 Lederer ..... F21L 4/08 362/183
2014/0218903 A1 * 8/2014 Sheng ..... F21S 10/046 362/190
2014/0340881 A1 * 11/2014 Tsai ..... F21S 6/001 362/190
2015/0036348 A1 * 2/2015 Dong ..... F21S 10/046 362/293
2015/0176789 A1 * 6/2015 Garcia ..... F21S 10/04 362/157
2016/0116127 A1 * 4/2016 Patton ..... F21S 6/001 362/284
2016/0290579 A1 * 10/2016 Au ..... F21S 10/046

* cited by examiner

*Primary Examiner* — Julie A Bannan
(74) *Attorney, Agent, or Firm* — Shimokaji IP

(57) ABSTRACT

An imitation candle lamp includes a candle cylinder, a lamp head, a imitation flame, an elastic shaft, a driving device and a power supply. The lamp head is installed on an upper end of the candle cylinder, the power supply is configured inside the candle cylinder, a through hole is provided at a middle of the imitation flame, the elastic shaft runs through the through hole and is fixed on the imitation flame, at least one end of the elastic shaft is fixed on the lamp head, the driving device is configured inside the lamp head and electrically connected with the power supply thereby driving the imitation flame to swing, and the elastic shaft is deformed accordingly to produce an elastic force whereby the imitation flame swings reversely. The lamp is power-saving and has excellent imitating effect.

8 Claims, 3 Drawing Sheets

IMITATION CANDLE LAMP

RELATED APPLICATIONS

This application claims the benefits of Chinese Patent Application No. 201710266171.2, filed on Apr. 21, 2017, the entire contents of which are hereby incorporated by reference in this application.

FIELD OF THE INVENTION

The present invention relates to an imitation candle lamp, and more particularly to an imitation candle lamp which is power-saving and has excellent imitating effect.

BACKGROUND OF THE INVENTION

Currently, for creating ambience in certain occasions, people often use imitation candle lamps to imitate actual candle flame effect. A conventional imitation candle lamp commonly utilizes a flame piece supported on the lamp head, an illuminator emitting light to the flame piece, and a driving device for driving the flame piece to swing, thereby obtaining faux flame effect. However, the flame piece is supported on the lamp head by a wire, and the flame piece may swing freely, thus the flame effect is not lifelike. Furthermore, the conventional flame piece does not simulate a black wick of a flaming candle, which degrades the verisimilitude. In addition, the swing of the conventional flame piece is relied upon the driving device all along, which requires larger energy consumption and reduces battery life.

SUMMARY OF THE INVENTION

One objective of the present invention is to provide an imitation candle lamp which is power-saving and has excellent imitating effect.

To achieve the mentioned above objective, an imitation candle lamp includes a candle cylinder, a lamp head, an imitation flame, an elastic shaft, a driving device and a power supply. The lamp head is installed on an upper end of the candle cylinder, the power supply is configured inside the candle cylinder, a through hole is provided at a middle of the imitation flame, the elastic shaft runs through the through hole and is fixed on the imitation flame, at least one end of the elastic shaft is fixed on the lamp head, the driving device is configured inside the lamp head and electrically connected with the power supply thereby driving the imitation flame to swing, and the elastic shaft is deformed accordingly to produce an elastic force whereby the imitation flame swings reversely.

In comparison with the prior art, since the elastic shaft is fixed on the imitation flame, one end of the elastic shaft is fixed on the lamp head, and the imitation flame is driven by the driving device to swing, so that the elastic shaft is twisted and deformed to generate elastic restoring force, thereby actuating the imitation flame to swing reversely, or along other opposite directions, up and down, left and right, or forward or backward. In such a way, imitating effect of real flame is obtained. In addition, a larger resilience force will be generated once the elastic shaft is deformed, whereby repeated reverse swings of the imitation flame will be generated by the repeated reverse deformations of the elastic shaft, in actual use, the imitation flame can produce repeat swings without external electrical driving. By this token, the driving times of the driving device are reduced, thereby reducing energy consumption, saving electric energy and extending battery life.

Preferably, the elastic shaft is made of elastic soft plastic.

Preferably, a groove is provided at an end of the elastic shaft, an engaging portion is provided at the lamp head, and the engaging portion is engaged with the groove.

Preferably, the lamp head comprises a left lamp head and a right lamp head which are detachably connected with one another, and a cavity is defined by the left lamp head and the right lamp head to receive the elastic shaft and the imitation flame.

Preferably, the imitation flame is a flame-shaped piece.

Preferably, the imitation flame is a flame-shaped shell.

Preferably, the lamp further includes an illuminant which is configured inside the lamp head to emit lights to a side of the imitation flame.

Preferably, the driving device comprises a circuit board, a coil and a magnet, the magnet is fixed to a lower end of the imitation flame, the coil is configured below the magnets and electrically connected with the circuit board, the circuit board is electrically connected with the power supply, and the magnet is driven by a magnetic field induced by the coil thereby actuating the imitation flame to swing.

Preferably, a bottom cover is covered on a bottom of the lamp head by means of a gasket.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
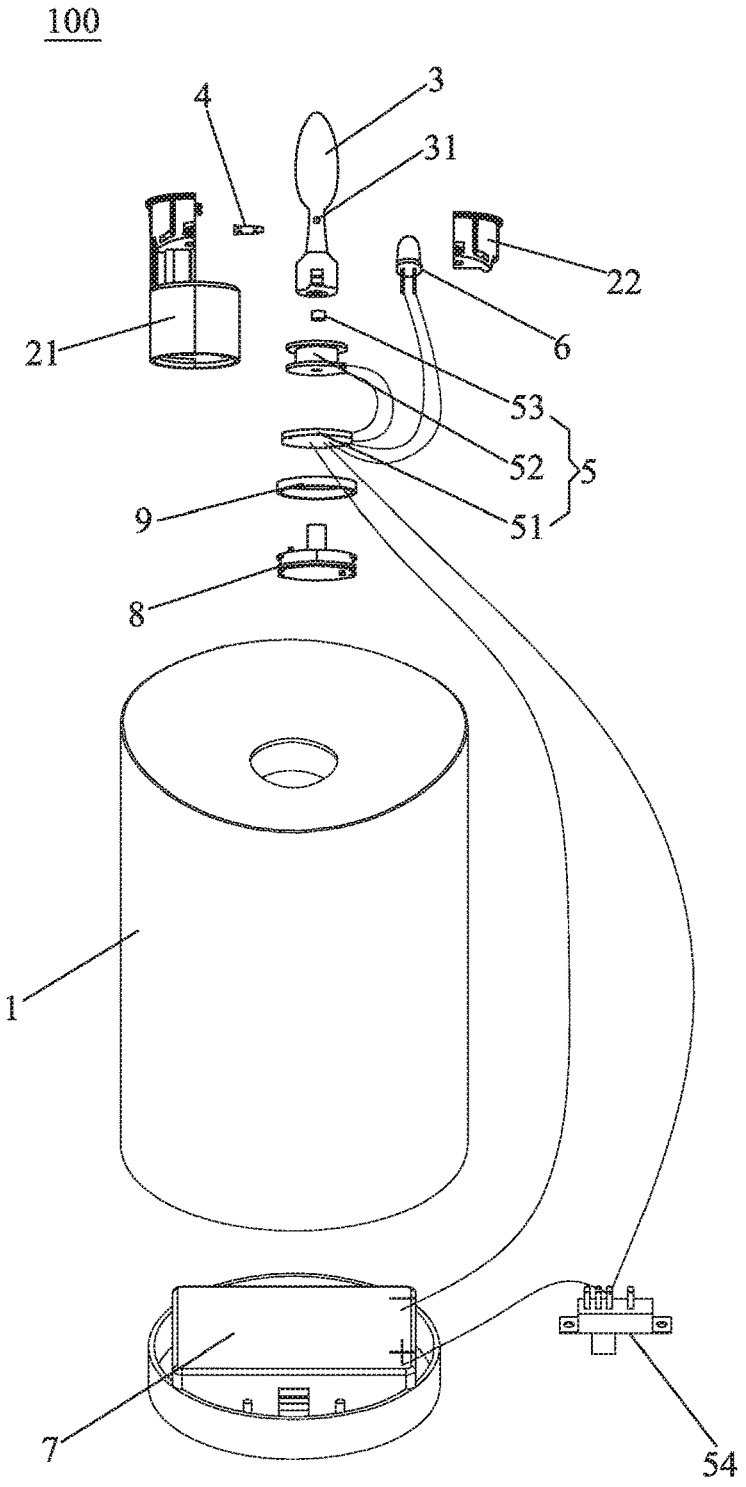
FIG. 1 an exploded view of an imitation candle lamp according to an embodiment of the present invention.
Figure 2:
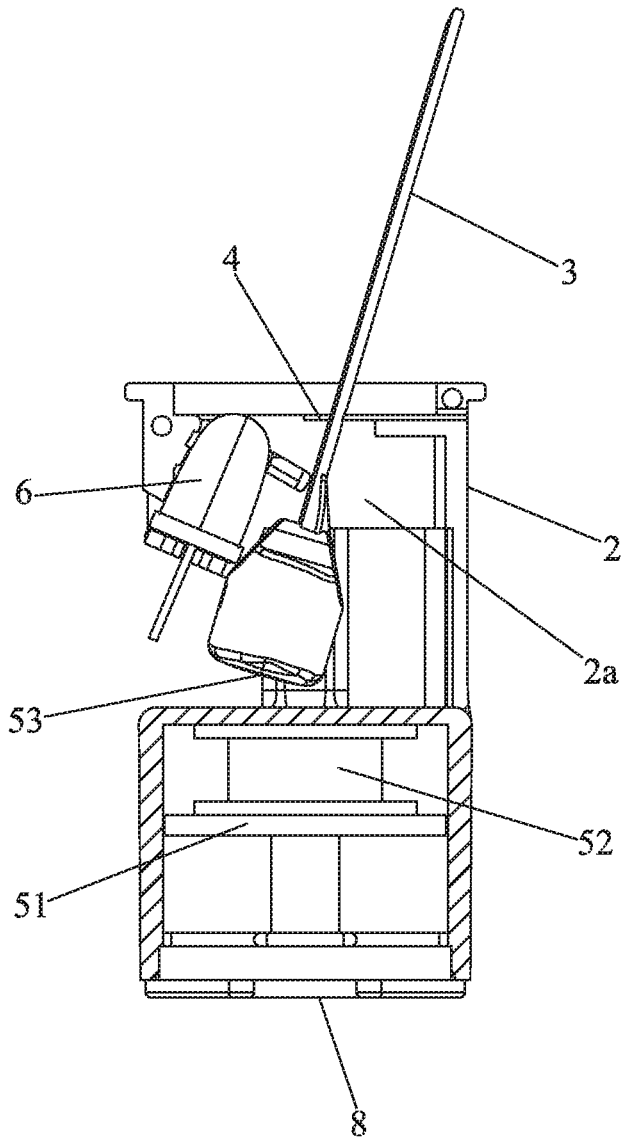
FIG. 2 is a sectional view of a lamp head of the imitation candle lamp according to an embodiment of the present invention.

As illustrated in FIGS. 1-2, an imitation candle lamp 100 of the present invention includes a candle cylinder 1, a lamp head 2, an imitation flame 3, a elastic shaft 4, a driving device 5, an illuminant 6 and a power supply. The lamp head 2 is installed on an upper end of the candle cylinder 1, and the power supply 7 is configured inside the candle cylinder 1. Specifically, the imitation flame 3 is shaped as a flame-shaped piece, a through hole 31 is provided at a middle of the imitation flame 3, the elastic shaft 4 runs through the through hole 31 and is fixed to the imitation flame 3, specifically, one end of the elastic shaft 4 is fixed to the lamp head 2, and the other end of the elastic shaft 4 is suspended. The illuminant 6 is configured in the lamp head 2 and located opposite to the elastic shaft 4 thereby emitting lights to a side of the flame. Preferably, the illuminant 6 is a LED.

Figure 3:
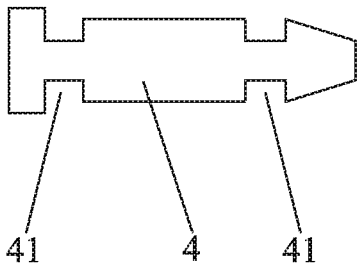
FIG. 3 is a schematic view of an elastic shaft of the imitation candle lamp according to an embodiment of the present invention.

As shown in FIG. 3, the elastic shaft is made of elastic soft plastic, such as silicone material preferably. Since the soft plastic has good elastic restoring force after it is twisted or deformed, thus the elastic shaft 4 made of elastic soft plastic may efficiently drive the imitation flame 3 to swing at a certain direction and swing reversely by means of its elastic restoring force, thereby simulating real candle flame realistically. A groove 41 is formed on the lower end of the elastic shaft 4, and an engaging portion (not shown) is formed on the lamp head 2, by means of the engagement of the engaging portion and the groove 41, the elastic shaft 4 can be fixed on the lamp head 2, thus, the elastic shaft 4 can be twisted or deformed by the swing motions of the imitation flame 3.

As shown in FIGS. 1 and 2 again, the lamp head 2 includes a left lamp head 21 and a right lamp head 22 which are detachably connected with one another, and a cavity 2*a* is defined by the left lamp head 21 and the right lamp head 22 to receive the elastic shaft 4 and the imitation flame 3. In such a configuration of the detachable left and right lamp heads 21 and 22, it's convenient to assemble the imitation flame 3 and the elastic shaft 4. Further, a bottom cover 8 is covered on a bottom of the lamp head 2 by means of a gasket 9.

As shown in FIG. 1 again, the driving device 5 includes a circuit board 51, coils 52 and a magnet 53, the magnet 53 is fixed to a lower end of the imitation flame 3, and the coils 52 are configured below the magnet 53 and electrically connected with the circuit board 51. A certain distance is set between the coils 52 and the magnet 53, thereby a magnetic field produced is capable of driving the magnet 53. The circuit board 51 is electrically connected with the power supply 7 by means of a switch 54, and the magnet 53 is driven by the magnetic field induced by the coils 52 thereby swinging the imitation flame 3.

In conclusion, when the power supply 7 supplies power to the coils 52, a magnetic field will be produced to actuate the magnet 53, as a result, the imitation flame 3 will swing due to the magnet motion, accordingly, the elastic shaft 4 will generate a forward torsional deformation or elastic deformation and have a reverse torsion or a reverse elastic force. If the coils 52 are power cut, the elastic shaft 4 will actuate the imitation flame 3 to swing reversely due to the reverse torsion or reverse elastic force. If a determined swing angle of the imitation flame 3 is reached, the elastic shaft 4 will generate a reverse torsional deformation or reverse elastic deformation again and have a forward torsion or a forward elastic force, which will actuate the imitation flame 3 to swing forward again. Once the elastic shaft 4 is actuated for several times by depending on the torsion force itself until the torsion force is exhausted, the coils 52 will be powered up again to generate magnetic fields to drive the imitation flame 3, so that cyclic swing of the imitation flame 3 can be achieved.

In comparison of the prior arts, since the elastic shaft 4 is fixed on the imitation flame 3, one end of the elastic shaft 4 is fixed to the lamp head 2, and the imitation flame 3 is driven by the driving device 5 to swing, so that the elastic shaft 4 is twisted and deformed to generate elastic restoring force, thereby actuating the imitation flame 3 to swing reversely, or along other opposite directions, up and down, left and right, or forward or backward. In such a way, imitating effect of actual flame is obtained. Further, since the elastic shaft 4 is completely and firmly fixed in the through hole 31 of the imitation flame 3, thus diameter of the elastic shaft 4 can be configured larger, by compared with the conventional wire shaft, therefore a black shadow will be presented at the middle of the imitation flame 3 when the elastic shaft 4 is illuminated by the illuminant 6; as a result, a black wick of a flaming candle is simulated to enhance the imitating effect. In addition, a larger resilience force will be generated after the elastic shaft 4 is deformed, whereby repeated reverse swings of the imitation flame 3 will be generated by the repeated reverse deformations of the elastic shaft 4, in actual use, the imitation flame 3 can produce repeat swings without external electrical driving. By this token, the driving times of the driving device 5 are reduced, thereby reducing energy consumption, saving electric energy and extending battery life.

In the present invention, two ends of the elastic shaft 4 can be fixed on the lamp head 2, so that the imitation flame 3 can swing around the elastic shaft 4 to cause torsional deformation, and a reverse swing also can be obtained due to the reverse torsion. In such a way, the imitation flame 3 also can obtain good imitating effect.

In addition, the imitation flame 3 of the present invention can be a flame-shaped shell, and the illuminant is configured outside the flame-shaped shell and located in the lamp head, so as to emit lights on the surface of the flame-shaped shell to simulate the real flame. Detailed structures of other components are similar to the above embodiment, which is not repeated here.

Work principles of the circuit board 51 and the coils 52 of the imitation candle lamp 100 are well known to the persons skilled in the art, which are not explained here.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An imitation candle lamp, comprising a candle cylinder, a lamp head, a imitation flame, an elastic shaft, a driving device and a power supply, wherein the lamp head is installed on an upper end of the candle cylinder, the power supply is configured inside the candle cylinder, a through hole is provided at a middle of the imitation flame, the elastic shaft runs through the through hole and is fixed on the imitation flame, at least one end of the elastic shaft is fixed on the lamp head, the driving device is configured inside the lamp head and electrically connected with the power supply thereby driving the imitation flame to swing, and the elastic shaft is deformed accordingly to produce an elastic force whereby the imitation flame swings reversely, wherein a groove is provided at an end of the elastic shaft, an engaging portion is provided at the lamp head, and the engaging portion is engaged with the groove.

2. The imitation candle lamp according to claim 1, wherein the elastic shaft is made of elastic soft plastic.

3. The imitation candle lamp according to claim 1, wherein the lamp head comprises a left lamp head and a right lamp head which are detachably connected with one another, and a cavity is defined by the left lamp head and the right lamp head to receive the elastic shaft and the imitation flame.

4. The imitation candle lamp according to claim 1, wherein the imitation flame is a flame-shaped piece.

5. The imitation candle lamp according to claim 1, wherein the imitation flame is a flame-shaped shell.

6. The imitation candle lamp according to claim 1, further comprising an illuminant which is configured inside the lamp head to emit lights to a side of the imitation flame.

7. The imitation candle lamp according to claim 1, wherein the driving device comprises a circuit board, a coil and a magnet, the magnet is fixed to a lower end of the imitation flame, the coil is configured below the magnets and electrically connected with the circuit board, the circuit board is electrically connected with the power supply, and the magnet is driven by a magnetic field induced by the coil thereby actuating the imitation flame to swing.

8. The imitation candle lamp according to claim 1, wherein a bottom cover is covered on a bottom of the lamp head by means of a gasket.

* * * * *